US005787108A

United States Patent [19]

Pavlicevic et al.

[11] Patent Number: 5,787,108

[45] Date of Patent: Jul. 28, 1998

[54] EXHAUST DEVICE FOR ELECTRIC ARC FURNACES AND RELATIVE METHOD

[75] Inventors: Milorad Pavlicevic, Udine, Italy; Peter Tishchenko, Donezk, Ukraine; Alfredo Poloni, Fogliano di Redipuglia; Angelico Della Negra, Povoletto, both of Italy

[73] Assignee: Danieli & C. Officine Meccaniche SpA, Buttrio, Italy

[21] Appl. No.: 842,821

[22] Filed: Apr. 17, 1997

[30] Foreign Application Priority Data

Apr. 30, 1996 [IT] Italy ..... UD96A0066

[51] Int. Cl.[6] ..... F27D 17/00

[52] U.S. Cl. ..... 373/9; 373/8; 373/77; 266/44; 266/157

[58] Field of Search ..... 373/2, 8, 9, 71, 373/73, 77, 108; 75/10 R, 25; 266/44, 157

[56] References Cited

U.S. PATENT DOCUMENTS

| | | | |
|---|---|---|---|
| 3,164,658 | 1/1965 | Yagi | 373/9 |
| 3,539,692 | 11/1970 | Heeney | 373/9 |
| 3,555,163 | 1/1971 | Lucas | 373/9 |
| 3,999,001 | 12/1976 | Overmyer et al. | 373/8 |
| 4,649,807 | 3/1987 | Aasen et al. | 373/9 |
| 5,392,312 | 2/1995 | Bernet et al. | 373/9 |

FOREIGN PATENT DOCUMENTS

| | | |
|---|---|---|
| 2488380 | 2/1982 | France . |
| 1205232 | 11/1965 | Germany . |
| 61-20661 | 1/1986 | Japan . |
| 865936 | 4/1961 | United Kingdom . |

OTHER PUBLICATIONS

Stahl Und Eisen, vol. 81, No. 10, pp. 686–687, May 11, 1961.

*Primary Examiner*—Tu B. Hoang

*Attorney, Agent, or Firm*—Stevens, Davis, Miller & Mosher, L.L.P.

[57] ABSTRACT

An exhaust device to suck in the fumes in an electric arc furnace (11) fed either by direct or alternating current. The furnace (11) comprises a crown (20) with at least one aperture (19) to introduce and position the electrodes (12) associated with a cupola, in a vertically raised position, which surrounds the electrodes (12) partially in a vertical direction. The cupola is smaller in diameter than the crown (20), there being included a fourth hole connected to the discharge pipe for the fumes (14). The cupola functions as a decantation chamber (13) substantially cylindrical in shape. The cupola functioning as a decantation chamber (13) including at its upper part a conduit (15) to discharge the fumes projecting tangentially and connecting the cupola functioning as a decantation chamber (13) to the discharge pipe (14), placed at the side of the cupola (13). A method to suck in fumes for an electric arc furnace fed either by alternating or direct current is also provided, wherein the furnace includes a fourth hole connected to a discharge pipe (14) for the fumes associated with a plant.

17 Claims, 2 Drawing Sheets

EXHAUST DEVICE FOR ELECTRIC ARC FURNACES AND RELATIVE METHOD

FIELD OF THE INVENTION

This invention concerns an exhaust device for electric arc furnaces, and the relative method.

BACKGROUND OF THE INVENTION

The exhaust device is applied advantageously in electric arc furnaces, whether they be fed in alternating or direct current, used in steel plants to melt metals, in cooperation with the conventional system for the forced intake of fumes.

The state of the art covers exhaust systems for the fumes which are normally used in electric arc furnaces, where intake means suck in the fumes from inside the furnace through a discharge conduit connected to a hole situated peripherally on the crown of the furnace and known as the "fourth hole".

From this hole, together with the incandescent fumes, a large quantity of granular slag and powdery slag comes out, which is then filtered by filters placed upstream of the intake device.

A deslagging door placed on the wall of the furnace, apart from allowing the excess slag to be removed from the surface of the molten metal, allows air to enter the furnace, and therefore the circulation of air which encourages the fumes to come out.

A problem which is often found in such furnaces is the presence of apertures in the central part of the crown, which allow the electrodes to be inserted and moved. No matter how builders try to make the apertures mate as closely as possible to the configuration of the electrodes, it is very difficult to achieve an air tight fit and a part of the fumes tends to escape from the apertures in any case, carrying with them considerable quantities of slag and powders, which are not filtered.

These fumes are extremely polluting, and therefore dangerous for the health and for the environment.

FR-A-2488380 discloses a cover for the electric furnace which is higher than the furnace and covers the whole width of the furnace. The fourth hole, through which the fumes are discharged, is at a tangent to the cover.

This solution gives considerable irregularity to the behaviour of the fumes in the cover, and does not filter them very efficiently, because of the large diameter of the high part of the cover.

This inefficient filtering is accompanied by a necessary increase in the intake of the fumes if this is to have a cooling effect on the electrodes.

This necessary increase in the intake also involves an increase in the loss of heat and a reduction in the yield of the furnace.

GB-A-865936 teaches to include a cupola around the electrodes which rises above the cover.

Moreover, the fourth hole for the extraction of the fumes starts from this cupola and, to be more precise, from its side.

This system gives a low level of filtering and a lack of uniformity in the removal of the fumes which, to be minimized, requires an increase in the intake and therefore a greater amount of cold air entering the furnace, with a consequent increase in the wear of the electrodes and a reduction in the yield of the furnace.

SUMMARY OF THE INVENTION

The present applicants have designed, tested and embodied this invention to overcome the shortcomings of the state of the art and to achieve further advantages.

The purpose of this invention is to provide a device, and the relative method, to perform a localised intake of the fumes from an electric arc furnace which will substantially prevent the fumes from escaping from the apertures in the crown which are necessary for the electrodes to be inserted and moved.

A further purpose of the invention is to obtain a forced circulation of the fumes inside the furnace, particularly in the area of the intake, which will cause at least some of the slag and powders, carried suspended in the fumes, to be deposited by a process of decantation, and therefore the said fumes can be sent to the filters already partially cleaned.

Another purpose of the invention is to maintain unchanged the intake of the fumes in such a way that there is no negative effect on the wear of the electrodes nor on the yield of the furnace.

A further purpose of the invention to separate the streams of fumes as they leave the intake chamber of the furnace to obtain the desired effects of cleaning and filtering the fumes.

According to the invention, the crown of the furnace has at the upper part a cupola functioning as a decantation chamber advantageously but not exclusively cylindrical in shape, placed in a central and circumscribed position with respect to the electrodes.

The cupola functioning as a decantation chamber has a smaller diameter than the crown of the furnace and comprises, on its lateral surface and advantageously near the covering or top, an aperture connected by means of the appropriate pipe with the discharge conduit associated with the fourth hole of the furnace.

The discharge conduit associated with the fourth hole is arranged at the side of the decantation chamber and is connected downstream with the usual intake systems, treatment systems and with the discharge chimney.

Thanks to the inclusion of the cupola functioning as a decantation chamber, two balanced streams of fumes are formed and leave the intake chamber of the furnace; these fumes advance at a reduced speed which thus assists the decantation and the filtering of the powders.

The first stream of fumes which leave the furnace surround the electrodes and then fill the cupola of the decantation chamber; a second stream is propagated from the fourth hole directly into the discharge conduit.

The exhaust device situated downstream of the discharge conduit, apart from taking in the fumes coming from the fourth hole, also sucks in those present in the cupola functioning as a decantation chamber by means of the said pipe provided for that purpose.

The pipe is orientated in such a way as to suck in the fumes tangentially from inside the cupola functioning as a decantation chamber, obliging them to follow a forced, spiral route before they escape.

This spiral route regularizes the turbulent movement of the fumes and allows the heavier particles of slag to decant and fall inside the furnace, thus reducing the quantity of slag suspended in the fumes. Moreover, the depression which is created inside the cupola functioning as a decantation chamber caused as the pipe which connects the cupola to the discharge pipe sucks in the fumes, prevents a large part of the fumes from escaping from the apertures situated in correspondence with the electrodes and from dispersing in the air without being filtered.

The reduced quantity of slag in the fumes, moreover, causes the filters associated with the exhaust device to last longer, with a consequent reduction in costs.

According to a variant, the discharge conduit associated with the fourth hole of the furnace has a first cylindrical segment with the function of a secondary decantation chamber, and the cupola above the crown functions as a first decantation chamber.

From the top of the cylindrical segment the fumes are sucked in tangentially by means of a second segment of orientated conduit arranged in a higher position than the cupola of the first decantation chamber.

This first, cylindrical segment of the discharge conduit has an aperture which communicates by means of the appropriate pipe with the peripheral aperture situated in the main decantation chamber.

The spiral circulation of the fumes obtained in the secondary decantation chamber, in a similar way to what happens in the main decantation chamber, causes a further depositing of the suspended particles of slag, with further benefits as shown above.

According to a variant, the main and secondary decantation chambers are adjacent.

In this case, the tangential intake of the fumes from the main decantation chamber is achieved through a window which connects the two chambers directly, without necessitating a connecting pipe.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENT

Figure 1:
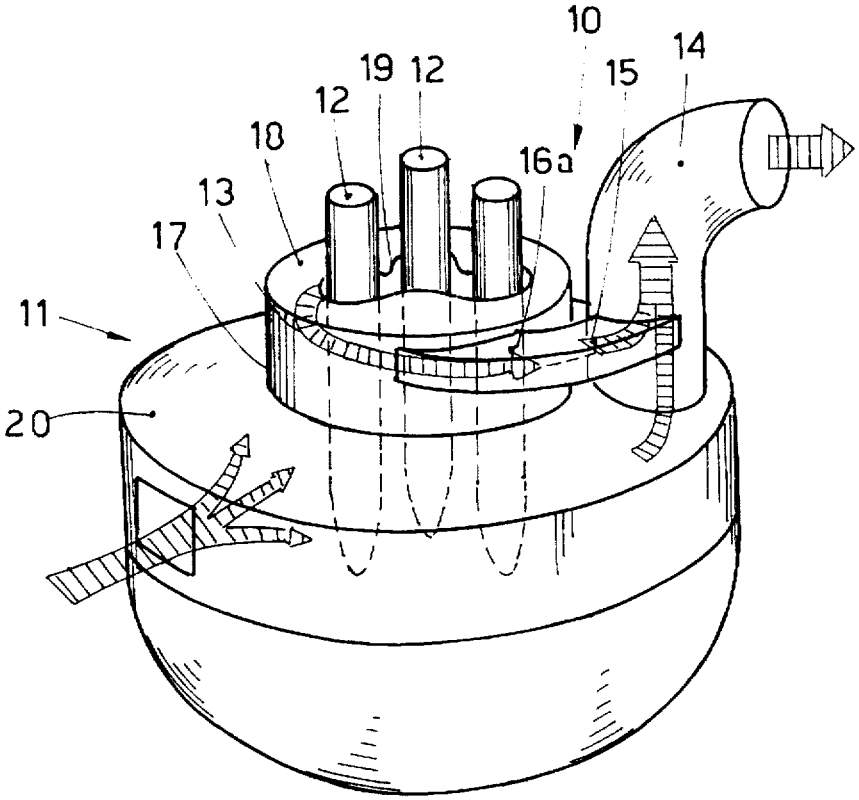
FIG. 1 is a diagrammatic prospective view of an electric arc furnace endowed with an exhaust device according to the invention.

The reference number 10 in the attached figures generally denotes an exhaust device for fumes in an electric arc furnace 11.

In this case, in the central part of the crown 20 and above it, in correspondence with the electrodes 12, there is a cylindrical cupola functioning as a decantation chamber 13 which vertically surrounds the electrodes 12, at least partly.

The cupola functioning as a decantation chamber 13 rises vertically with respect to the crown 20, has a smaller diameter than that of the crown 20 and is placed, in this case, in a substantially coaxial position with respect to the crown 20.

The cupola functioning as a decantation chamber 13 moreover is arranged at the side of the discharge conduit 14 which connects the fourth hole of the furnace, that is the outlet hole for the fumes, to the intake systems, the treatment systems and the chimney, which are not shown here.

The cupola functioning as a decantation chamber 13 has, in this case, a height of between 400 and 800 mm and the side wall 17 is at a distance of between 800 and 1200 mm away from the electrodes 12.

On the side wall 17, and in proximity of the top 18 of the cupola functioning as a decantation chamber 13, there is a window **16*a*, advantageously of a rectangular or elliptic shape, of a height between 100 and 150 mm and communicating with the discharge pipe 14 by means of a conduit 15**.

The positioning of the window **16*a* near the top 18 of the cupola functioning as a decantation chamber 13 defines a large area through which the fumes coming from inside the furnace pass before they are removed from the cupola functioning as a decantation chamber 13**.

The side wall 17 of the cupola functioning as a decantation chamber 13, the walls of the discharge pipe 14 and the walls of the conduit 15 which connects the cupola functioning as a decantation chamber 13 to the discharge pipe 14 are all, for at least part of their length, associated with cooling means which are not shown here.

These cooling means consist of pipes for the circulation of cooling water, configured as panels which substantially reproduce the inner geometry of the pipe or conduit into which they are inserted.

At the stage when the fumes are sucked in from the furnace 11, which process is carried out substantially in a conventional manner by an exhaust device not shown here and placed downstream of the discharge pipe 14, the fumes present in the cupola functioning as a decantation chamber 13 are sucked in through the conduit 15. The conduit 15 is orientated tangentially with respect to the side wall 17 of the cupola functioning as a decantation chamber 13, so that the fumes which have been sucked in follow a forced, spiral route before they escape from the window **16*a***.

According to a variant, the window **16*a*** can have a plurality of fins to induce the spiral route of the fumes.

The function of this route is to regularise the turbulent flow of the fumes inside the furnace 11 and inside its upper part, which allows a part of the suspended slag to decant and fall back inside the furnace 11 as a result of gravity. As part of the slag is thus deposited, the fumes sucked in and sent to the filters placed in proximity of the exhaust device are already partially cleaned, which extends the working life of the filters, not shown here.

A further advantage of the invention is that the intake of the fumes by the conduit 15 causes a depression inside the cupola functioning as a decantation chamber 13 which prevents the fumes from escaping from the aperture 19 which is situated in the top of the cupola functioning as a decantation chamber 13 through which the electrodes 12 are inserted. As a result, fumes which have not been filtered, and therefore are full of polluting slag, are not dispersed in the atmosphere.

Figure 2:
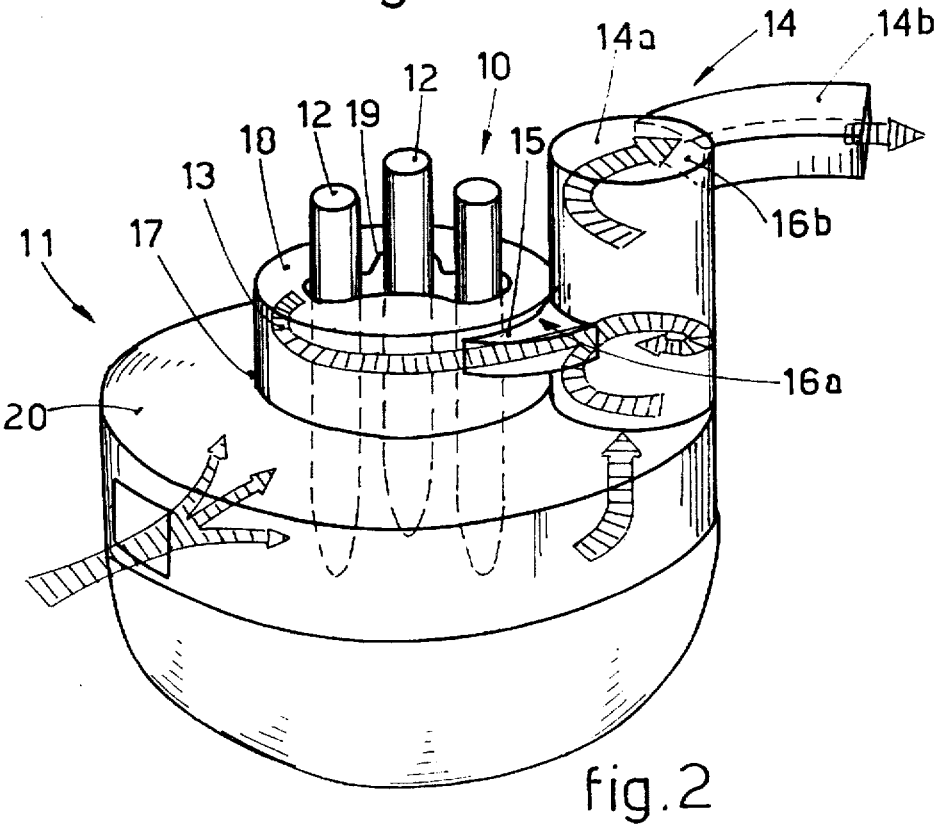
FIG. 2 shows a variant to FIG. 1.
Figure 5:
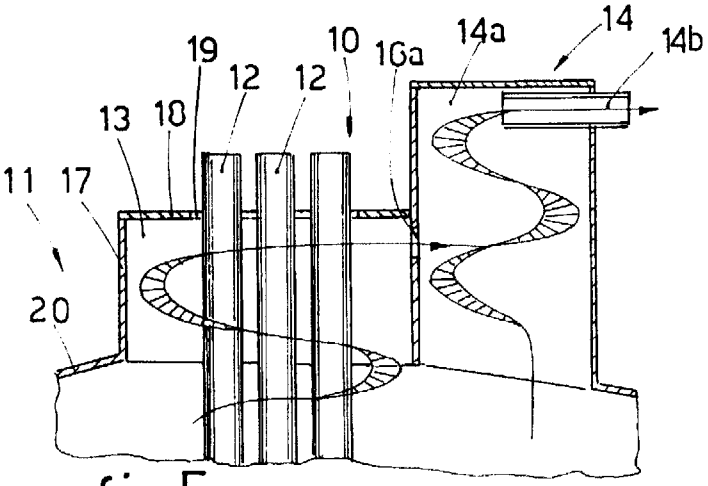
FIG. 5 shows in diagrammatic form a side view of the electric arc furnace in FIG. 2.
Figure 6:
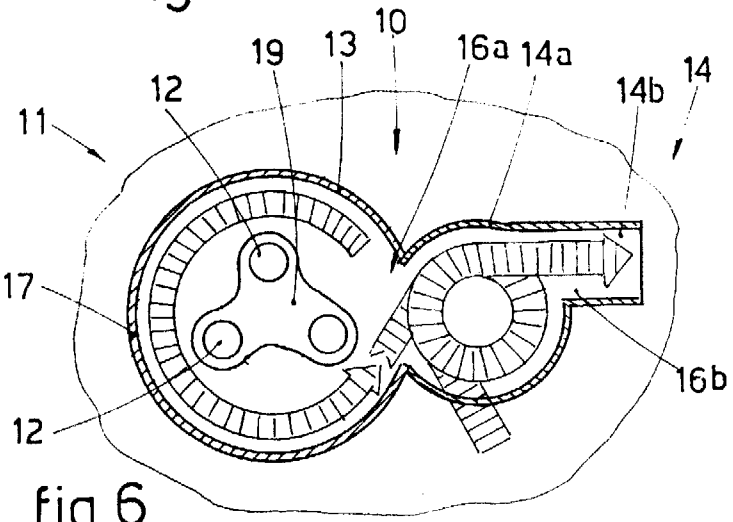
FIG. 6 is a diagrammatic plan view of the electric arc furnace in FIG. 2.
Figure 3:
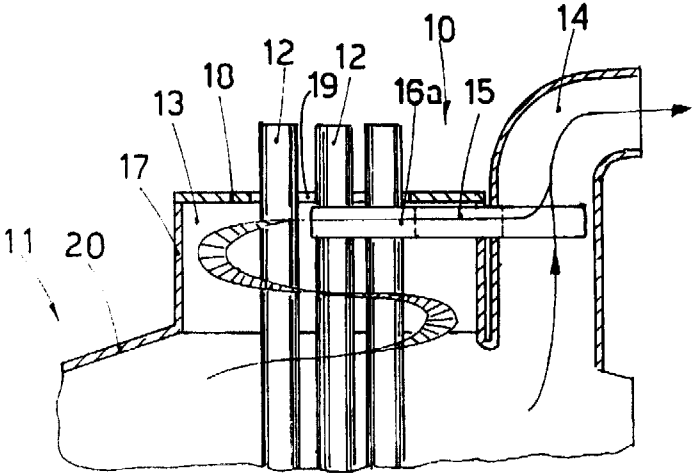
FIG. 3 shows in diagrammatic form the side view of the electric arc furnace in FIG. 1.
Figure 4:
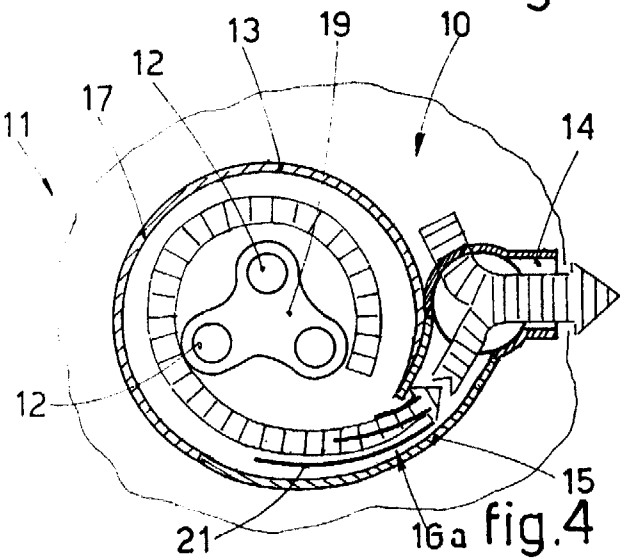
FIG. 4 is a diagrammatic plan view of the electric arc furnace in FIG. 1.

According to a variant of the invention, shown in FIGS. 2, 5, and 6, a first segment **14*a* of the discharge pipe 14 functions as a secondary decantation chamber, itself serving as a deposit site for the suspended slag and powders. In the embodiment shown, the fumes are removed from the first segment 14*a* by means of an aperture 16*b* connected to a second segment 14*b* of the discharge pipe 14 orientated tangentially. This induces a spiral movement of the fumes as they rise in the discharge pipe 14**, accentuating by decantation the process of separation of the slag suspended in the fumes and the at least partial filtration of the fumes.

As shown in FIGS. 2, 5 and 6, the first segment **14*a* of the discharge pipe 14** is higher than the first decantation chamber 13 and communicates with the first decantation chamber 13 through the conduit 15 which is placed in an intermediate position of the first segment 14*a*.

The window 16*a* from which the fumes are sucked in from the first decantation chamber 13, is orientated substantially with the same orientation as the immission window of the fumes in the first segment 14*a*.

The orientation of the intake window 16*a* and the window in the first segment 14*a* are such that the fumes sucked in by the fourth hole are further assisted to follow a spiral route so that the fumes can be filtered, as the powders and slag decant.

Moreover, the tangential orientation of the intake window 16*a* is coordinated with the tangential orientation of the second segment 14*b* with respect to the first segment 14*a*, so as to ensure the continuity of the spiral movement of the two streams of fumes, one leaving the fourth hole and the other leaving the first decantation chamber 13.

In the variant shown in FIGS. 2, 5 and 6, the quantity of slag decanted from the fumes and which returns to the furnace is greater, which increases still further the life of the filters.

The vertical position of the discharge pipe 14*b* is higher than the upper part of the connection between the conduit 15 and the first segment 14*a* by at least 200 mm.

When the first segment 14*a* of the discharge pipe 14, or second decantation chamber, is obtained substantially tangent to the first decantation chamber 13, as in FIGS. 2 and 6, the conduit 15 is reduced to a minimum.

The discharge pipe 14*b* will have an orientation such as to cooperate with the action of the intake window 16*a* and the immission window in the first segment 14*a* in order to induce the fumes in the first segment 14*a*, or second decantation chamber, to rise in a spiral movement.

We claim:

1. An exhaust device for electric arc furnace (11) whether fed by alternating or direct current, the furnace (11) comprising a crown (20) with at least one aperture (19) to introduce and position the electrodes (12) and associated with a cupola which partly surrounds the electrodes (12) in a vertical direction, the cupola being of a smaller diameter than the crown (20), there also being on the crown (20) a fourth hole connected to a discharge pipe (14) for exhausting fumes, the cupola being vertically elevated and the discharge pipe (14) being governed by means to suck in the fumes, the device being characterised in that the elevated cupola is a decantation chamber (13) substantially cylindrical in shape, the cupola functioning as a decantation chamber (13) having at its upper part a conduit (15) to discharge the fumes which projects tangentially and connects the cupola functioning as a decantation chamber (13) to the discharge pipe (14), the discharge pipe (14) being placed at the side of the cupola (13).

2. The exhaust device as in claim 1, in which the cupola functioning as a decantation chamber (13) communicates with the conduit (15) by means of an intake aperture (16*a*) comprising orientated fins to direct and guide the fumes to rise tangentially inside the cupola functioning as a decantation chamber (13).

3. The exhaust device as in claim 2, in which the cupola functioning as a decantation chamber (13) has a height of at least 400 mm.

4. The exhaust device as in claim 1, in which the side wall (17) of the cupola functioning as a decantation chamber (13) is placed at a distance of at least 700 mm from the perimeter of the nearest electrode (12).

5. The exhaust device as in claim 2, in which the height of the intake aperture (16*a*) is at least 100 mm.

6. The exhaust device as in claim 1, in which the discharge pipe (14) is defined by a first segment (14*a*) substantially cylindrical and vertical and having at its upper part a discharge conduit (14*b*) projecting tangentially from the first segment (14*a*).

7. The exhaust device as in claim 6, in which the height of the first segment (14*a*) is greater than that of the cupola functioning as a decantation chamber (13).

8. The exhaust device as in claim 6, in which the vertical distance measured on the first segment (14*a*) between the upper part of the conduit (15) and the lower part of the discharge conduit (14*b*) is at least 200 mm.

9. The exhaust device as in claim 6, in which the tangential projection of the discharge conduit (14*b*) on the first segment (14*a*) is coordinated with the orientation of the projection of the conduit (15) on the same first segment (14*a*).

10. The exhaust device as in claim 1, in which the side wall (17) of the cupola functioning as a decantation chamber (13) is associated with cooling means consisting of panels of cooling pipes.

11. The exhaust device as in claim 1, in which the inner wall of the discharge pipe (14) is associated with cooling means consisting of panels of cooling pipes.

12. The exhaust device as in claim 1, in which the inner wall of the conduit (15) is associated with cooling means consisting of panels of cooling pipes.

13. A method to suck in fumes in an electric arc furnace, the furnace comprising a crown (20) with at least one aperture (19) for introducing and positioning electrodes (12) and associated with a cupola which partly surrounds the electrodes (12) in a vertical direction, where the furnace, whether fed by alternating or direct current, includes a fourth hole formed in the crown (20) connected to a pipe (14) to discharge the fumes associated with a plant with means to suck in the fumes, wherein the stream of fumes sucked in, before entering into the main discharge pipe (14), is divided into two currents of which the first surrounds the upper electrodes (12) and rises above the crown (20) of the furnace inside a cupola which functions as a decantation chamber (13), this current being induced to rise in a spiral, and the second current passing from the fourth hole directly into the discharge pipe (14).

14. The method as in claim 13, in which a depression is maintained in the cupola (13) functioning as a decantation chamber.

15. The method as in claim 13, in which the second current of fumes which passes through the fourth hole is made to rise in the discharge pipe (14) with a spiral development.

16. The method as in claim 13, in which the first current of fumes joins the second current of fumes at a tangent to it, and at an intermediate position of the second current.

17. The method as in claim 13, in which the outlet channel of the first and second currents of fumes is arranged tangentially to accentuate the spiral development of the rising fumes.

* * * * *